United States Patent [19]

Alspaw

[11] 4,146,095

[45] Mar. 27, 1979

[54] METHOD AND APPARATUS FOR NUCLEAR HEATING OF OIL-BEARING FORMATIONS

[76] Inventor: D. Ivan Alspaw, 334 Meadows Bldg., Dallas, Tex. 75206

[21] Appl. No.: 815,920

[22] Filed: Jul. 15, 1977

[51] Int. Cl.[2] ..... E21B 43/24

[52] U.S. Cl. ..... 166/247; 166/57; 166/302

[58] Field of Search ..... 166/247, 272, 302, 305 D, 166/314, 57; 165/45

[56] References Cited

U.S. PATENT DOCUMENTS

| | | | |
|---|---|---|---|
| 3,080,918 | 3/1963 | Natland | 166/247 |
| 3,108,439 | 10/1963 | Reynolds et al. | 166/305 D |
| 3,233,669 | 2/1966 | Williams | 166/247 |
| 3,246,695 | 4/1966 | Robinson | 166/247 |
| 3,262,274 | 7/1966 | Nelson, Jr. | 166/247 X |
| 3,274,784 | 9/1966 | Shock et al. | 166/247 X |
| 3,349,850 | 10/1967 | Schlicht et al. | 166/247 X |
| 3,373,811 | 3/1968 | Burtch | 166/247 |
| 3,500,910 | 3/1970 | Triplett et al. | 166/247 |
| 3,864,208 | 2/1975 | Van Huisen | 166/247 X |
| 4,040,480 | 8/1977 | Richards | 166/305 D X |

*Primary Examiner*—Stephen J. Novosad
*Attorney, Agent, or Firm*—Darryl M. Springs

[57] ABSTRACT

A method and apparatus are provided for using heat generated by absorption of radiation from nuclear waste materials to reduce the viscosity of petroleum products contained within a subsurface earth formation. The nuclear waste material is positioned in a salt water formation underlying the subsurface earth formation so that the radiation emitted by the material heats the salt water formation. Conduction and convection transfer the heat to the subsurface earth formation, raising the temperature and thereby reducing the viscosity of the petroleum products. To prevent radioactive contamination within the salt water formation, the nuclear waste material may be encapsulated in a material selected to absorb alpha and beta radiation.

11 Claims, 5 Drawing Figures

FIG. 2
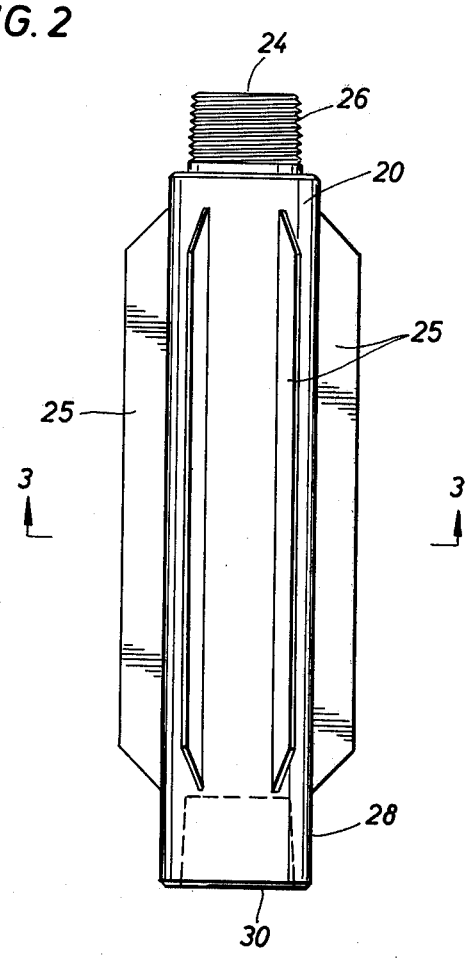
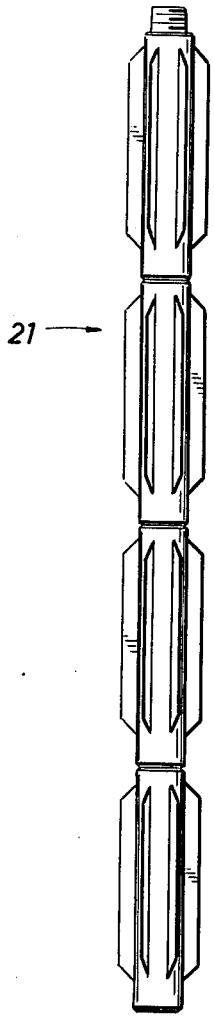
FIG. 4
FIG. 3
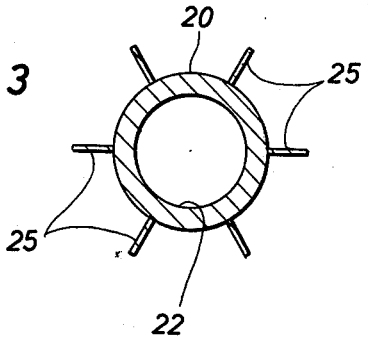
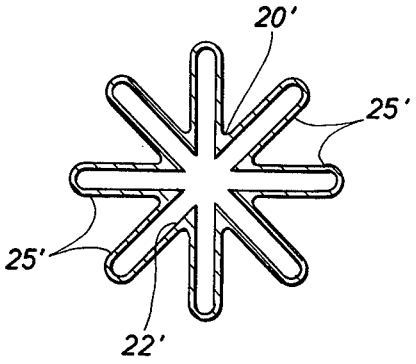
FIG. 5

METHOD AND APPARATUS FOR NUCLEAR HEATING OF OIL-BEARING FORMATIONS

BACKGROUND OF THE INVENTION

This invention relates to a method for recovering high-viscosity oil from subsurface formations, and in particular, relates to a method for reducing the viscosity of the oil by the in-situ heating of an underlying salt water formation using heat produced by heat energy radiating nuclear waste materials.

It is well known in the petroleum industry that there are vast reservoirs of petroleum materials in the earth which have not been produced because the petroleum exists in a highly viscous and waxy state such that it cannot be pumped by conventional means. Such petroleum products include those known as tar sands, oil shale and asphalt rock. As a result of this common condition, many methods have been attempted for recovering the petroleum in such deposits. Among such methods is included increasing the temperature of the petroleum in-situ in the earth formation to lower its viscosity, thereby enabling conventional production methods to be used to recover the petroleum.

Prior methods have employed chemical heating means or electrical heaters suspended within the bore holes adjacent the petroleum-bearing strata, and the passage of electric current through the formation by the use of electrodes in the plurality of adjacent wells. Additionally, gases such as $CO_2$ have been pumped down into a well and into the oil-bearing formation to chemically combine with the oil and lower its viscosity, and in other applications the oil itself has even been ignited to produce heat and gases which would generate pressure to force the oil out of the formation into adjacent well bores while heating the viscous petroleum in the formation.

The above-mentioned prior art systems have met with only limited success for two primary reasons. First, the prior art arrangements have encountered major difficulties in supplying an adequate source of heat within the bore hole itself and ultimately to the formation over extended periods of time. Secondly, the prior art apparatus and methods for removing oil have lacked an efficient means for effectively transferring the heat from a heat source within the bore hole or limited area surrounding the bore hole to the petroleum-bearing strata itself. Such conventional heat sources as heretofore employed for these purposes are, from a thermodynamic standpoint, a point source of heat since the actual dimension of the heating source itself is practically negligible as compared to the size and volume of the surrounding formation.

In recent years, attempts to reduce the viscosity of the petroleum contained in subsurface strata have been directed to the use of nuclear reactions in which the greater portion of the energy released by the reactions is liberated as heat. One such method, described in U.S. Pat. No. 3,246,695, utilizes energy-radiating nuclear waste material placed within a bore hole to a point within the subsurface petroleum-bearing strata. As an added benefit, a use is found for radioactive wastes which in recent years has presented a serious disposal problem.

However, implacement of nuclear wastes within the petroleum-bearing strata must be carefully controlled in order to avoid increasing the temperature of the strata arbitrarily, thus charring the crude oil surrounding the implacement point and changing the permeability and flow characteristics of the formation. If such charring does occur, the removal of the petroleum may become even more difficult than prior to the application of the heat.

The disadvantages of the prior art, and especially the invention claimed in the afore-mentioned U.S. patent are overcome with the present invention and a method for reducing the viscosity of subsurface petroleum-bearing deposits is disclosed. More particularly, the method of the present invention permits use of higher concentrations of nuclear waste material without overheating or damaging the subsurface petroleum deposit and any problems related to possible radioactive contamination of the recovered petroleum is avoided, and a safe and convenient means is provided for disposing of spent nuclear waste material.

SUMMARY OF THE INVENTION

This invention is for an improved method of reducing the viscosity of petroleum situated in subsurface strata by utilizing the heat of reaction of nuclear waste material to elevate the temperature of an underlying water strata to cause a corresponding elevation of temperature in the petroleum-bearing strata overlying the water strata. The invention is particularly adaptable for use when the strata comprises a salt water formation underlying the oil-bearing structure.

A brief review of the sources of radioactive nuclear waste materials and their characteristics is necessary here. The use of nuclear energy in this country is progressing at a rapid pace, leading to the construction of numerous facilities which produce energy from nuclear fission. In a typical fission reactor, a neutron is absorbed by a fissionable material, resulting in fission of that material with a resulting release of energy and the production of other neutrons and other elements, both radioactive and inert. The elemental by-products are commonly referred to as fission products and accumulate within the reactor throughout the power generating lifetime of a particular fuel element. A wide variety of fission products are produced, the actual distribution of which depends upon the particular fission process utilized, with both long-lived and short-lived products. The short-lived products generally have half-lives measured in terms of hours whereas the longer-lived products have half-lives measured in terms of years. A further distinction between fission products is the mechanism by which they decay, i.e., the type of radiation which is immanated.

The actual distribution of fission products obtained from a given reactor will depend upon the specific fission process which occurs within the reactor. Hence, no generalization is attempted with respect to a particular mix of fission isotopes which might be available to use in the present invention. In all of the fission processes in use today, the fuel becomes expended at some time and must be removed from the reactor for processing. In all of the processes, the radioactive fission isotopes are separated from the fissionable materials for disposal, while the fissionable materials are recovered and processed into fuel elements for other reactors.

The fission products which remain after processing are generally the long-lived products since there is an appreciable delay between the time a fuel element is removed from a reactor and the time it is actually subjected to processing. The actual residue from the processing operation is voluminous and must be reduced in volume for efficient handling. This volume reduction can be accomplished by any number of conventional distillation techniques whereby the radioactive isotopes are further separated from non-radioactive material and concentrated into a form for disposal. Disposal of such material poses difficult environmental problems to prevent contamination of the atmosphere, or the earth.

The package of these concentrated isotopes requires careful consideration, balancing between the need to shield the environment from harmful radioactivity and the need to provide for removal of the heat generated from the decay processes. The radiation emitted by the fission products may be any of the three prevalent radiations: alpha, beta or gamma ray. Alpha radiation requires only a minor shielding but the capture of these rather "large" particles produces considerable heat generation. Beta radiation (electron emission) requires moderate shielding and again this capture results in significant heat generation. Gamma radiation (X-ray radiation) is the most penetrating of the radiations emitted and requires a heavy lead shielding which typifies most shielding installations. For purposes of the present invention, it would be desirable to prepare an isotope mix in which the beta and alpha radiations are predominant.

A table of radio-isotopic materials that possess the decay characteristics above discussed are provided in the *Standard Handbook for Mechanical Engineers* (Seventh Edition, 1967). Typically strontium and cesium are some of the more common fission products available in a sufficient quantity.

In a preferred embodiment, a bore hole is provided from the surface to a location within the selected salt water formation for accepting the nuclear waste material container, and, producing bore holes are provided that extend into the petroleum-bearing strata from the surface and in a preselected proximity to the heat producing bore hole.

Nuclear waste material, which has been packaged in a convenient form for shipment to the input bore hole location is positioned therein at a location below the oil bearing formation. Preferably the waste material is positioned within an underlying salt water layer. Alpha, beta and gamma particles given off by the nuclear waste material create heat which elevates the temperature of the salt water, thereby elevating the temperature of the overlying oil stratum by convection from the heated water.

The shielded package of radioactive isotopes must also provide for removal of the heat generated. Accordingly, it is felt that in actual practice, the present invention would probably require that limited quantities of radioactive waste materials be placed in shipping containers which can be adequately cooled by ambient conditions and thereafter assembled at the drill site into a final package for insertion into the selected strata or formation.

Once the nuclear waste material package is implaced in or adjacent to a salt water strata, heating can occur in a variety of ways. Direct heating will occur as a result of gamma ray emission from the relatively unshielded container. Heating of the container will occur due to the absorption of beta and alpha radiation. This heat will be transferred to the surrounding stratum by conduction through the rock and convection of the salt water within the stratum. As the temperature of the salt water elevates, convection elevates the temperature of the overlying petroleum-bearing strata, with the attendant reduction in the viscosity of the petroleum. The petroleum products can then be withdrawn in a conventional manner.

In summary therefore, it is a feature of the present invention to provide a method for thermally reducing the viscosity of hydrocarbon materials contained in a subsurface strata.

It is a further feature of the present invention to reduce the viscosity of hydrocarbon materials by elevating the temperature of the hydrocarbon-bearing strata through heating the underlying strata.

It is still another feature of the present invention to elevate the temperature of the strata underlying a hydrocarbon material strata through the use of reaction heat produced by nuclear waste materials.

Still another feature of the present invention is to elevate the temperature of the hydrocarbon-bearing formation without causing thermal damage to the formation.

These and other features and advantages of the present invention will become apparent from the following detailed description, wherein reference is made to the figures in the accompanying drawings.

BRIEF DESCRIPTION OF THE DRAWINGS

In order that the manner in which the above-recited advantages and features of the invention are attained can be understood in detail, a more particular description of the invention may be had by reference to specific embodiments thereof which are illustrated in the appended drawings, which drawings form a part of this specification. It is to be noted, however, that the appended drawings illustrate only typical embodiments of the invention and therefore are not to be considered limiting of its scope for the invention may admit to further equally effective embodiments.

In the drawings:

FIG. 2 is a shipment container for radioactive materials intended for insertion into the selected earth strata.

FIG. 3 is a cross-sectional view of the container depicted in FIG. 2.

FIG. 4 is an insertion package assembled by interconnecting a plurality of the shipment containers depicted in FIG. 2.

FIG. 5 is a cross-sectional view of an alternative embodiment of the shipment containers depicted in FIG. 2.

DETAILED DESCRIPTION OF THE PREFERRED EMBODIMENT

Figure 1:
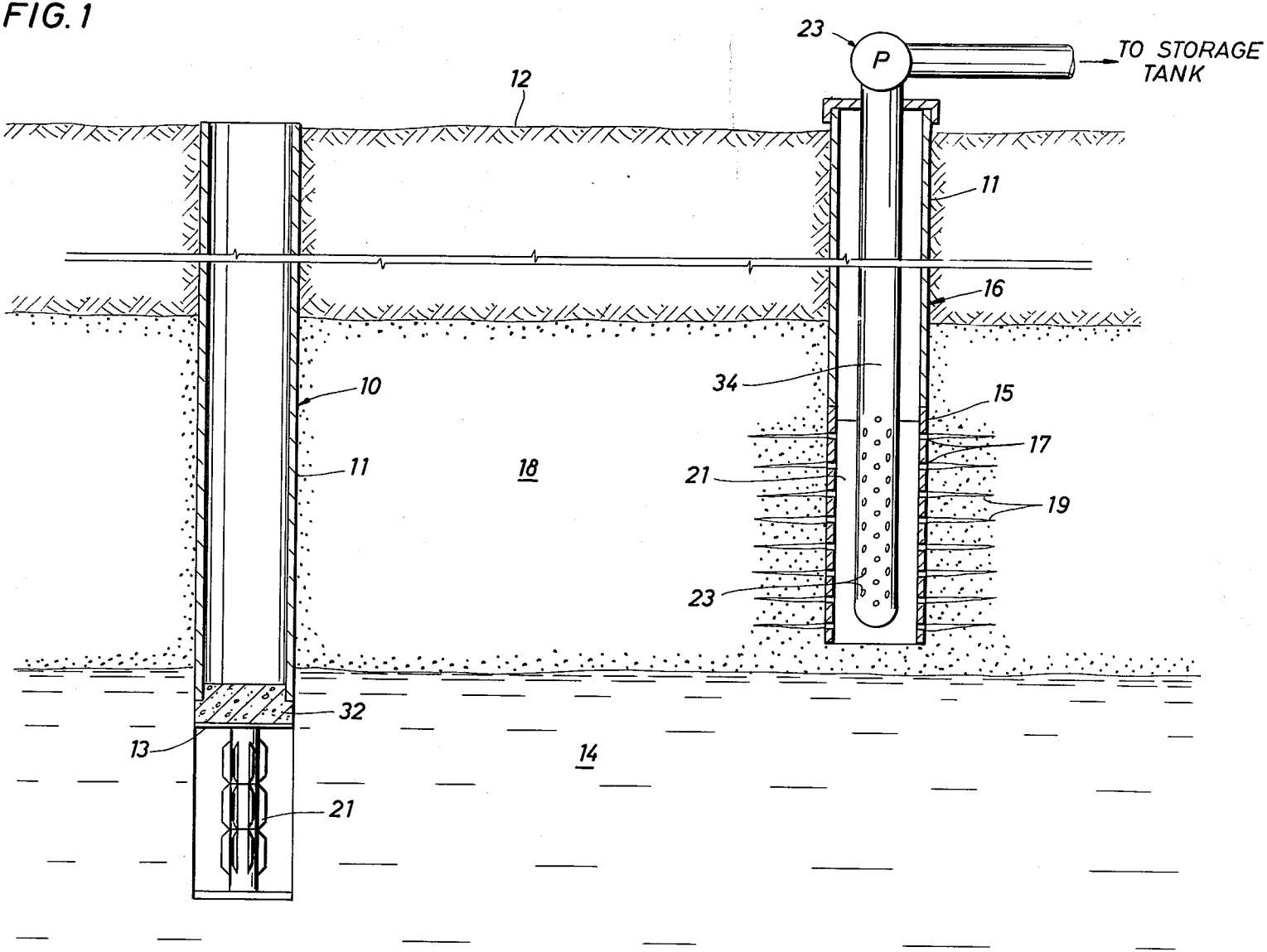
FIG. 1 is a cross-section of the earth at a point where a reservoir of entrapped petroleum having an underlying salt water strata lies some distance below the surface and depicts the method of the present invention.

Referring now to FIG. 1, there is shown a preferred embodiment for heating a selected petroleum-bearing formation in-situ. A conventional bore hole 10 is shown extending from the surface of the earth 12 to a location within the selected salt water strata or formation 14. Bore hole 10 can be completed in a conventional manner by use of steel casing 11. The casing 11 may extend through bore hole 10, or in some applications, the casing 11 may terminate either at or just below the interface between the salt water formation 14 and the petroleum producing formation of interest 18.

A nuclear waste container 21 is assembled (as will be hereinafter described) at the well site and using conventional oil tool equipment, the container 21 will be lowered into bore hole 10 and implaced in the bore hole in the salt water formation 14. Bore hole 10, within formation 14, may be sealed by means of a conventional packer or sealing plate 13, and a cement plug 32 can be positioned above the seal 13 to seal the lower portion of the bore hole, containing nuclear waste container 21, from the remaining portion of the bore hole and to shield the remaining portion of the bore hole 10 from radiation.

A conventional producing bore hole 16 is shown extending from the earth's surface 12 and terminating within the petroleum-bearing formation 18. The producing bore hole 16 will also be conventionally cased or lined by a steel casing 11, and the portion of the bore hole 16 within the formation of interest 18, may also be cased by a suitable casing section 15. Casing section 15 may be conventionally perforated to form perforations 17 and to create cracks or fissures 19 into the formation 18. A tubing string 34 with a conventional pump 23 will be positioned within bore hole 16. Oil from formation 18, its viscosity lowered by the heat generated by nuclear waste container 21, will flow through the fissures 19 and perforation 17 into the interior of well bore 16 and accumulate in the well bore as a standing column of oil 21. The viscosity lowered oil can then be conventionally pumped to the surface of the earth by means of pump 23 cooperating with a conventional tubing string 34 having perforations 23, or other suitable openings for intake of the oil 21 for storage in an appropriate storage facility (not shown).

Once in position, nuclear waste package 21 will begin to heat the salt water formation 14 in a variety of ways. Direct heating of the salt water formation 14 will occur as a result of gamma ray emission from the relatively unshielded package 21. Heating of the package 21 will occur due to the absorption of alpha and beta radiation by the shielding material of package 21, the construction of which will be hereinafter described and by the nuclear waste material itself. Heat generated by alpha and beta radiation absorption within the nuclear waste material will be transferred to the shielding material of package 21 by conduction. The heated package 21 will transfer heat to the surrounding strata 14 by conduction through the rock, sand and clay constituents of formation 14 and by convection to the salt water within the formation. The primary mechanism for heating the salt water strata will be conduction through the surrounding rock structure. Thereafter, convection and vertical conduction of heat will transfer heat to the overlying oil strata 18 and serve to elevate the temperature of the overlying oil strata and thus reduce the viscosity of the oil in formation 18, which can then be removed in a conventional manner as hereinabove discussed.

It is anticipated that the nuclear waste material container 21 will be implanted in the bore hole 10 to remain for an extended period of time before sufficient heat has been supplied to raise the temperature of the surrounding structure sufficiently to significantly reduce the viscosity of the oil. It may also be desirable to include some mechanism for natural convection circulation of salt water from formation 14 through the interior of container 21 to insure proper cooling of the container and also increase the surface area which contacts the salt water in formation 14. It will also be apparent, that by drilling a plurality of bore holes 10 and disposing a plurality of nuclear waste packages 21 in a predetermined design or pattern throughout an oil-bearing reservoir, a comprehensive pattern of heating of the salt water formation 14 will be accomplished for heating a broad area of the petroleum-bearing formation 18. In addition, such heating of the petroleum materials in formation 18 may also release absorbed and trapped gases in the petroleum materials which may act to elevate the formation pressure and help provide a drive for the oil or petroleum substances into producing well bore 16. Further, it is also anticipated that other secondary and tertiary recovery methods could be used in conjunction with the present invention to recover the heated oil.

Referring now to FIGS. 2, 3 and 4, there is shown a suggested cylindrical container 20 designed to be filled with radioactive isotope waste material in any form, either a liquid, solid or gas. Container 20 may conveniently be made from a selected material, such as steel, having sufficient structural integrity to permit insertion of container 20 into the bore hole 10, without damage to the container which may result in release of the nuclear waste material into the bore hole 10. Further, as various nuclear waste materials have different radiation characteristics the density of the material used in forming container 20 and the wall thickness of the formed container 20 may be preselected to provide for the desired absorption of alpha and beta radiation. Container 20 has an interior chamber 22 sized to hold a predetermined amount of nuclear waste material. The amount of waste material carried within each cylinder will be determined by the maximum heat generated by the decay process of the radioactive isotopes, for insuring that each filled container 20 may be transported under ambient conditions without special need for means of cooling the container 20. One way in which to insure such removal of the heat generated by the waste nuclear material within container 20 is to provide sufficient surface area on container 20 that allows the heat to be conducted away by conduction through the container walls and thereafter transferred to the atmosphere by convection. One effective means of providing such increased surface area is by providing ribs or fins 25. If necessary, provisions for circulating a coolant through and around container 20 could be provided during transport, but this would greatly reduce the ability to transport the containers along commercial routes. Accordingly, in the actual practice of the present invention, it would probably require that limited quantities of radioactive isotopes be placed in containers 20 in order that the containers can be adequately cooled by ambient conditions and thereafter assembled and filled with additional isotope material at the bore hole site into a final package 21 for insertion in formation 14.

One extremity of container 20 is formed with a reduced diameter end portion 24 having external threads 26 for mating with the opposite end of another cylinder 20 having a recess 28 and threads 30. After transportation of the desired number of containers 20 to the bore hole site, a nuclear waste package 21 may now be prepared, if such a package was not suitable for shipment assembled as such. A suitable package 21 may be formed by connecting several containers 20 together into a string or column by means of the threaded portions 26 and 30 of each container 20. In this manner, an elongated nuclear waste package 21 may be assembled as shown in FIG. 4. The insertion package must include sufficient shielding (not shown) to protect the workmen at the earth's surface during the insertion of package 21 into bore hole 10, although this shielding probably need not necessarily accompany package 21 into wellbore 10.

Subsequent recovery of package 21, if necessary, would be accomplished by withdrawing package 21 back into a suitable shielded structure at the earth's surface. Again, depending upon the final concentration of radioactive isotopes within package 21, an external cooling source may have to be provided for temperature maintenance of package 21 during insertion of the package into wellbore 10 and into the salt water formation 14. If a cement plug 32 is positioned above package 21 to seal the bore hole, as shown in FIG. 1, the package 21 could be recovered at a future time by drilling through plug 32 and grasping the package 21 with conventional downhole recovery tools.

Referring now to FIG. 5, an alternative shape 20' is suggested for the nuclear waste container. As depicted, the container 20' is formed to provide integral ribs or fins 25' and an interior cavity 22' shaped to correspond to the exterior surface of the container 20'. Again, interior chamber 22' is designed to hold a predetermined amount of nuclear waste material with the shape of interior chamber 22' permitting the nuclear waste material to be positioned within the fins 25'. This spreading of the nuclear waste material into the fins 25' reduces its concentrated mass, thereby reducing the absorption heat buildup within the material itself.

Further, container 20' may be formed with mating threads (not shown) at opposing extremities to permit the assembly of a nuclear waste package (not shown) as above-described for container 20. Use of this package will be as above-described for package 21.

It will be apparent from the foregoing description, that many other variations and modifications may be made in the method and apparatus described herein without substantially departing from the essential concept of the present invention. Accordingly, it should be clearly understood that the forms of the invention described herein and depicted in the accompanying drawings are exemplary only, and are not intended as limitations to the scope of the present invention.

What is claimed is:

1. A method of heating high viscosity petroleum products in a selected subsurface earth formation overlying a salt water formation, comprising the steps of providing an input bore hole into said salt water formation, providing a production bore hole into said petroleum product formation and in spaced relation to said input bore hole, positioning in said input bore hole and within said salt water formation a selected source of nuclear waste material, the radiation emissions of which generate sufficient heat for increasing the temperature of the salt water in said formation sufficiently to increase the temperature of said formation containing said petroleum products for reducing the viscosity of said products, and withdrawing said reduced viscosity petroleum products through a said production bore hole.

2. The method of claim 1, further including the step of encapsulating said source of nuclear waste material prior to positioning in said input bore hole in a selected material having a thickness and density preselected to effect capture of alpha and beta radiation for generating heat in said material.

3. The method of claim 2, further including the steps of encapsulating limited quantities of said nuclear waste material in containers which are effectively cooled by ambient conditions, transporting said containers to said input bore hole location, assembling said containers into a package suitable for insertion in said input bore hole, and containing a sufficient quantity of said nuclear waste material to effect said temperature increase.

4. The method of claim 1, further including the steps of selecting said nuclear waste material from the group consisting of cesium and strontium fission products.

5. The method of claim 1, further including the step of sealing said bore hole at a location within said salt water formation and substantially adjacent to said overlying subsurface earth formation.

6. Apparatus for heating high viscosity petroleum products in a selected subsurface earth formation overlying a salt water formation, comprising generating means for producing heat from nuclear waste material, access means defining a first bore hole extending from the earth's surface into the salt water formation for positioning said generating means within said salt water formation, said generating means operative to reduce the viscosity of said high viscosity petroleum products, and production means defining a second bore hole extending from the earth's surface into said selected subsurface formation, said second bore hole in spaced relation to said first bore hole, for withdrawing said reduced viscosity petroleum products from said selected subsurface earth formation.

7. The apparatus of claim 6, wherein said generating means comprises an elongated cylinder defining a plurality of interior chambers, and a preselected quantity of radiation producing nuclear waste material positioned within each said interior chamber.

8. The apparatus of claim 7, wherein said elongated cylinder comprises a plurality of interconnected cylindrical sections, each of said cylindrical sections encompassing one of said plurality of interior chambers.

9. The apparatus of claim 8, further including a plurality of heat radiating fins attached to each of said plurality of cylindrical sections.

10. The apparatus of claim 8, further including a plurality of heat radiating fins integrally formed on an exterior surface of each of said plurality of cylindrical sections.

11. The apparatus of claim 8, wherein each of said plurality of cylindrical sections includes a reduced diameter end portion having external threads formed thereon and an opposing recessed end portion having internal threads formed therein, said external threads on each cylindrical section cooperatively engageable with said internal threads on another cylindrical section to interconnect said cylindrical sections for forming said elongated cylinder.

* * * * *